US005971210A

United States Patent [19]

Brugger

[11] Patent Number: 5,971,210

[45] Date of Patent: Oct. 26, 1999

[54] DISPENSER FOR A LIQUID MEDIUM CONSISTING OF TWO COMPONENTS

[76] Inventor: Gerhard Brugger, Schongauer Strasse 10, Marktoberdorf, Germany, D-87616

[21] Appl. No.: 09/109,305

[22] Filed: Jun. 30, 1998

Related U.S. Application Data

[62] Division of application No. 08/686,124, Jul. 23, 1996, Pat. No. 5,848,732.

[30] Foreign Application Priority Data

Jul. 23, 1995 [DE] Germany ..... 295 11 932

[51] Int. Cl.[6] ..... B67D 5/52

[52] U.S. Cl. ..... 222/137; 222/145.8

[58] Field of Search ..... 222/134, 135, 222/145.6, 145.7, 145.8, 257, 137

[56] References Cited

U.S. PATENT DOCUMENTS

| | | | |
|---|---|---|---|
| 3,760,986 | 9/1973 | Castner et al. | 222/137 |
| 4,771,919 | 9/1988 | Ernst | 222/145.7 |
| 4,773,562 | 9/1988 | Gueret | 222/135 |
| 4,826,048 | 5/1989 | Skora et al. | 222/135 |
| 4,893,729 | 1/1990 | Iggulden et al. | 222/145.7 |
| 5,158,438 | 10/1992 | Olson et al. | 417/360 |
| 5,169,029 | 12/1992 | Behar et al. | 222/145.7 |
| 5,385,270 | 1/1995 | Cataneo et al. | 222/145.8 |
| 5,848,732 | 12/1998 | Brugger | 222/137 |

FOREIGN PATENT DOCUMENTS

| | | |
|---|---|---|
| 26902 | 4/1981 | European Pat. Off. . |
| 427609 | 5/1991 | European Pat. Off. . |
| 520315 | 12/1992 | European Pat. Off. . |
| 676339 | 10/1995 | European Pat. Off. . |

*Primary Examiner*—Philippe Derakshani
*Attorney, Agent, or Firm*—Morgan & Finnegan, L.L.P.

[57] ABSTRACT

The present invention generally refers to a dispenser for a liquid medium consisting of two components. The dispenser in particular comprises two accomodation compartments for two different components of the material to be dispensed. Each of the accomodation compartments has an outlet and a mixer connected thereto. The mixer is manually adjustable by means of an adjuster and changes the ratio of the supplied components of the medium. Finally, the dispenser comprises a dispenser nozzle for the medium to be dispensed, which is connected to the mixer.

6 Claims, 5 Drawing Sheets

DISPENSER FOR A LIQUID MEDIUM CONSISTING OF TWO COMPONENTS

This application is a divisional application of application Ser. No. 08/686,124, filed Jul. 23, 1996 now U.S. Pat. No. 5,848,732.

BACKGROUND OF THE INVENTION

The present invention refers to a dispenser for a liquid medium consisting of two components.

Bottles and cans are available for accomodating liquid media for every day use, such as washing-up liquid, liquid soap, perfumes, sun tan lotion and the like, said bottles or cans being provided with an upper part in which a manually operable pump is disposed, by means of which the content of the container may be pumped to a dispenser nozzle. Containers of this kind are generally known.

A device for dispensing liquid agents to be mixed at a given ratio is known from DE-OS 33 16 922, said device having a plunger-cylinder system having a number of juxtaposed cylinders including a rejection plunger each, said number corresponding to the amount of agents to be mixed. These cylinders are the reservoirs for the agents to be dispensed, and their effective volume is reduced by displacing the plungers upon an increase in consumption. All plungers are moved by a spindle mechanism which can be operated at a hand wheel.

A dispenser for a hair dye is known from EP-A-0 510 352, said dispenser containing a second container, accomodating a hair dye developer, in a first container, accomodating a propellant. The dispenser further comprises an output nozzle and a valve structure having first and second valves, that are connected to both containers and the output nozzle and that are operated simultaneously to enable a simultaneous output of the liquids contained in the first and second containers under the influence of the propellant, wherein the mixing ratio of the container contents is not changed at the output nozzle.

BRIEF DESCRIPTION OF THE INVENTION

There are applications in which a person intends to personally adjust or change the mixing ratio of a liquid consisting of two components according to his/her own desire. Sun tan lotion is a typical example. The un-irradiated skin of the human being is more sensitive to solar radiation than tanned skin. If the skin is exposed to the sun for the first time, a higher light protection factor has to be chosen than if the skin is more or less tanned by the sun. In order not to need a variety of sun tan lotion of different light protection factors, there is a need for a sun tan lotion with which the light protection factor can be adjusted individually. Since this can practically only be accomplished by mixing two different sun tan lotions of differently high light protection factors, the dispenser for a liquid medium was developed, which can dispense two liquid components at a freely selectable mixing ratio.

This object is accomplished by the invention claimed herein.

In the scale of the invention, two concepts are possible, namely a concept in which the outlets of two accomodation compartments of a container for different, liquid media are directly connected to a mixer, the mixing ratio of which being adjustable and the output of which possibly being connected through a pump with a dispenser nozzle, and another concept, in which the outlets of two accomodation compartments are connected to a separate pump, the outlets of which being connected to a common mixer and the supply volumes of which being mutually adjustable.

The advantage of the concept including the two pumps is that after changing the mixing ratio, the newly adjusted ratio is obtained relatively quickly at the dispenser nozzle. In the other concept it is possible only after some pump operations to achieve the newly adjusted ratio.

BRIEF DESCRIPTION OF THE DRAWINGS

The invention will now be described by reference to the embodiments shown in the drawings.

DETAILED DESCRIPTION OF THE INVENTION

Figure 1:
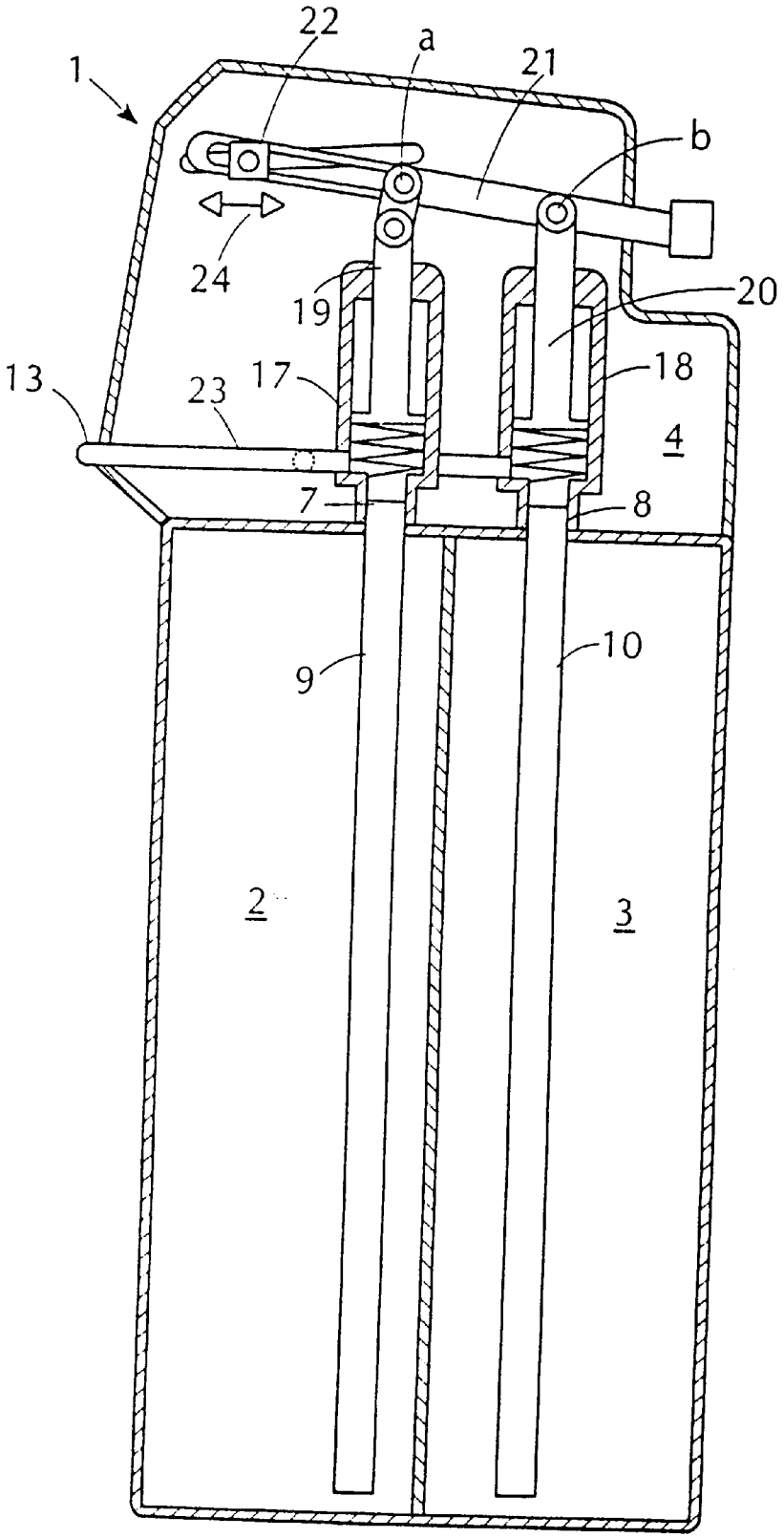
FIG. 1 is an embodiment with two pumps having mutually adjustable supply volumes.

FIG. 1 shows an embodiment of the invention with a container 1 divided into two accomodation departments 2 and 3 and into a head chamber 4. Two pumps 17 and 18 are disposed within the head chamber, the inlets 7 and 8 of which being connected to suction lines 9 and 10 which project into the accomodation compartments 2 and 3. The pumps 1T and 18 have plungers, the plunger rods 19 and 20 of which being connected to a common pump lever 21 at different locations a and b, which have different spacing from pivot bearing 22 of the lever in head chamber 4.

The outlets of the pumps 17 and 18 are connected to a common mixing pipe 23, which leads to a dispenser nozzle 13.

According to FIG. 1, the location of the pivot bearing 22 of the pump lever 21 is adjustable towards the left and towards the right. This is shown in FIG. 1 by the arrow 24. Since the supply volumes of the pumps 17 and 18 at a given pivot angle of the pump lever 21 are defined by the spacing of the points a and b to the pivot bearing 22, the ratio of the volumes of the pumps 17 and 18 supplied per pump lever stroke and thus the ratio of the dispensed components of the accomodation compartments 2 and 3 can be altered by adjusting the pivot bearing 22 according to arrow 24. It is understood that the adjustment mechanism for the pivot bearing 22 is accessible from the outside, e.g. as a turning knob of a spindle drive.

Finally it has to be mentioned that the accomodation compartments shall be refillable in order to use the dispenser in a quite economical way.

FIGS. 2A, 2B, 2C, and 3 show a further embodiment of the dispenser according to the invention claimed in the parent case. Those portions of this embodiment that correspond to those of the above-mentioned embodiments, are characterized by the same reference numerals and are thus not further described.

The adjustment means in this case consists of an operating element 24 to be operated by the operator from the outside for adjusting the ratio of the liquid to be pumped from the compartments. The operating element 24 is rotatably supported in a correspondingly formed opening in the container 1. A coupling pin 25 projects from the side of the operating element 24 facing the interior of head of the container, said bearing couplin pin 25 being guided in a longitudinal slot of a coupling element 26, See FIGS. 2A and 3. The coupling element 26 is hingedly connected to the two pumps 17, 18 and is displaced when rotating the operating element 24, thereby pivoting the pumps 17, 18 (See FIG. 3). The upper ends of the pumps plungers have bearing rollers 27, 28, that are guided in guiding rails 29, 30 which form a twin lever arrangement. This enables a pivot movement of the pumps along a circular-sector shaped path. The guide rails 29, 30 each have a pivot bearing 31 located in the proximity of the outer wall of the head of the container 1. Thereby, the guide rails 29, 30 transfer a pressure, exerted on the dispenser nozzle 13 as acutation means downwards, to the plunger rods of both pumps 17, 18 at the same time.

Figure 2A:
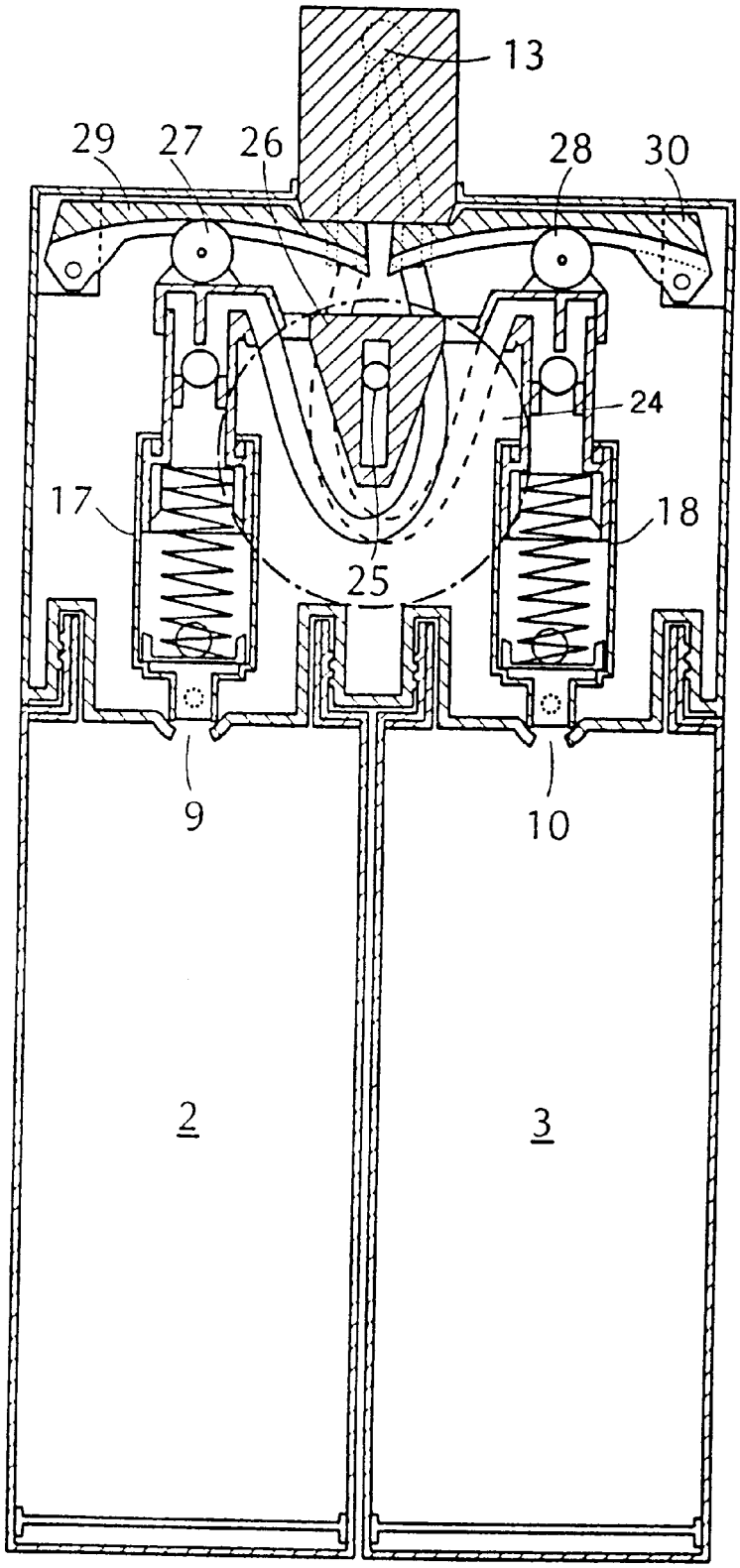
FIGS. 2A, 2B, and 2C show a further embodiment with two pumps in a front view, a side view and top view.
Figure 2B:
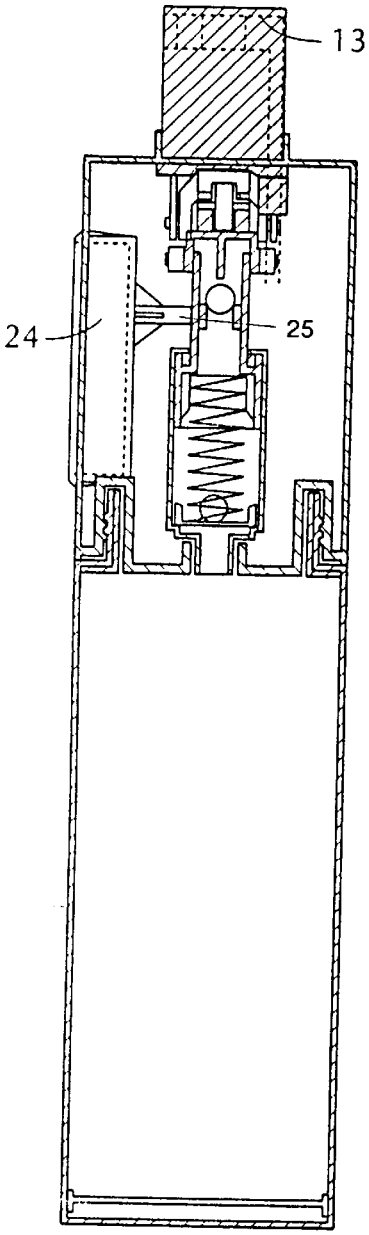
Figure 2C:
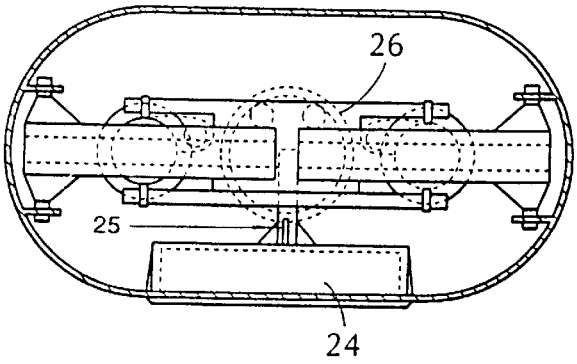
Figure 3:
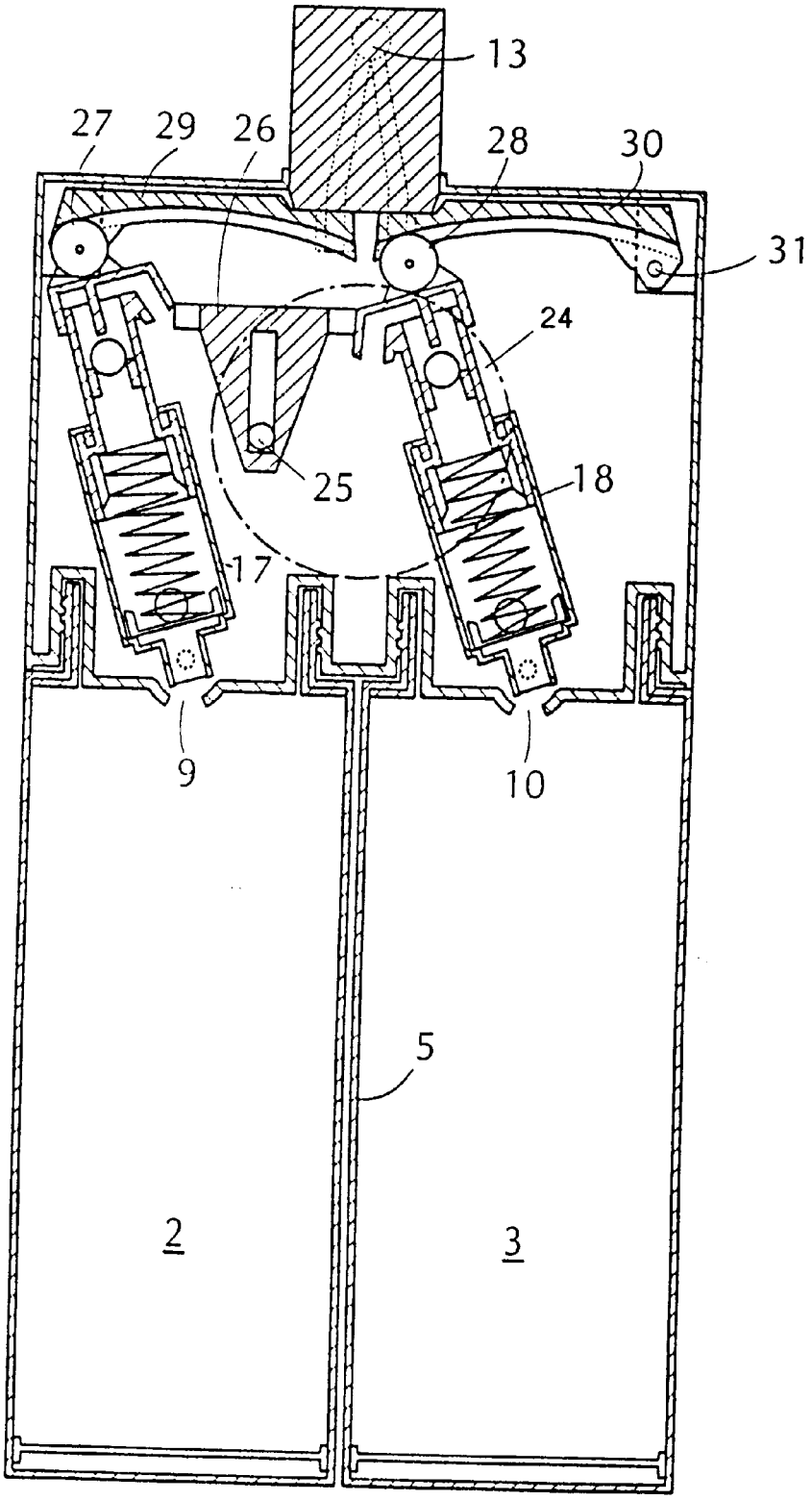
FIG. 3 shows is a view of the embodiment of FIGS. 2A, 2B, and 2C, in a front view, wherein the supply volume of the pumps is changed with respect to the view of FIGS. 2A, 2B, and 2C.

If the coupling pin 25 is in the position shown in FIG. 2A, the stroke of the two pumps 17, 18 is equally great. In contrast thereto, in the position of the coupling pin 25 shown in FIG. 3 the stroke of the pump 18, is at its maximum and the stroke of the pump 17 is at its minimum. The person skilled in the art recognizes that the ratio of the liquids to be supplied is infinitely variable. The outlet openings of the pumps 17, 18 are connected to the dispenser nozzle 13 through flexible hose lines, as can be seen from the front view of the dispenser in FIG. 2A. For reasons of clarity, the hose lines are not shown in FIG. 3. The dispenser nozzle 13 has a mixing pipe, as is shown in the embodiment of FIG. 1.

It has to be emphasized in the embodiment of FIGS. 2A, 2B, 2C and 3 that the bottom of the accomodation compartments "move along" to prevent the generation of air bubbles, in particular if the dispenser is not in an upright position.

Figure 4:
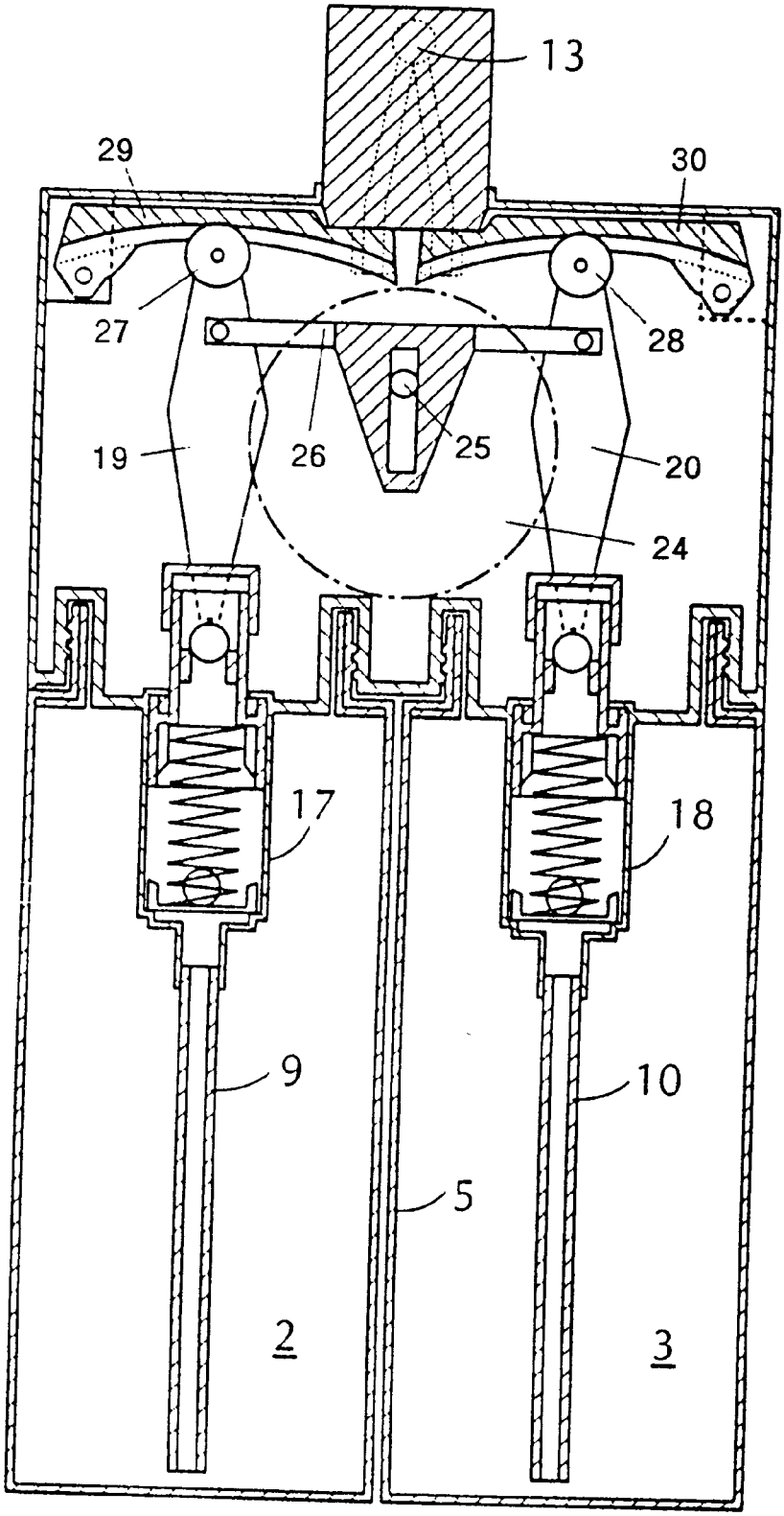
FIG. 4 is an alternative of the embodiment of FIGS. 2A, 2B, 2C, and 3.

A second embodiment making use of various features of the dispenser shown in FIGS. 2A, 2B, 2C, and 3 as disclosed in FIG. 4 shows an embodiment with two suction lines 9, 10 similar to the embodiment in FIG. 1.

Whereas in the dispenser of FIGS. 2A, 2B, 2C, and 3 the pumps are pivotally supported in total to enable a variation of the ratio of liquid supply, in the second embodiment of the invention shown in FIG. 4 the pumps 17 and 18 are fixedly mounted as in the embodiment of FIG. 1 and are actuated via plunger rods 19 and 20, respectively, which are pivotally mounted by their lower ends at the plungers of said pumps. The plunger rods 19 and 20 are hingedly coupled to one another by a coupling element 26, as in FIG. 2A having a guiding slot which is engaged by a coupling pin 25 affixed to an operating element 24 similar to that of FIG. 2A. The upper ends of said plunger rods 19, 20 have bearing rollers 27, 28 which are guided on guiding rails 29, 30, comparable to the bearing rollers in the embodiment of FIG. 2A.

As may be seen from FIG. 4, as in the embodiment of FIG. 2A, by rotating the operation element 24, the effective length of the lever arms formed by the guiding rails 29, 30 can be mutually varied in opposite sense, thereby varying the ratio of the pumping strokes effected by the plunger rods 19, 20 resulting in a variation of the ratio of liquid supply from the compartments 2 and 3.

What is claimed is:

1. A dispenser for a liquid medium, comprising a container divided into two accommodation compartments for two different components of the medium to be dispensed, an outlet means at each of the accommodation compartments, a mixing means connected to each outlet means, a manually adjustable adjustment means by means of which a ratio of the components of the medium supplied to the mixing means can be selected, a dispenser nozzle for the medium to be dispensed by the dispenser which nozzle is connected to the mixing means, wherein the outlet means are each connected to a discharge pump having a plunger and an outlet which opens into the mixing means, each plunger being connected to a plunger rod, said plunger rods being in engagement with lever means pivotally mounted in a head of said dispenser and being engaged by a single actuation means, and wherein a ratio of effective arm lengths of said lever means where said plunger rods are in engagement with said lever means is manually adjustable by said adjustment means so as to adjust a ratio of pumping strokes of said plungers.

2. A dispenser as set forth in claim 1, wherein the plunger rods each have one end pivotally mounted to a respective plunger and a second end displaceably retained at one of two guide rails forming said lever means.

3. A dispenser as set forth in claim 2, wherein the plunger rods are connected to one another through a coupling element engaged by an operating element of said adjustment means in a manner that upon operation thereof a pivot movement of the plunger rods is caused, which causes the lengths of said effective arm lengths of said lever means acting at the plunger rods to be changed.

4. A dispenser as set forth in any one of the preceding claims, wherein the outlets of the discharge pumps are connected to the mixing means through flexible hose lines.

5. A dispenser as set forth in claim 1, wherein said lever means comprises a single manually operable pump lever supported in a pivot bearing in a head of said dispenser, the plunger rods being hingedly connected to said pump lever at two locations having different spacing to said pivot bearing, wherein the pivot bearing is adapted to be displaced in a manner to change the spacing of said plunger rod connecting locations to said pivot bearing by manually adjusting said adjustment means.

6. A dispenser as set forth in claim 5, wherein the pivot bearing is adjustable by means of a spindle drive.

* * * * *